United States Patent [19]

Day

[11] 3,969,608

[45] July 13, 1976

[54] VISCOUS LIQUID CONVEYING APPARATUS

[76] Inventor: Joseph M. Day, 4231 Elmonte St., Saginaw, Mich. 48603

[22] Filed: Oct. 15, 1974

[21] Appl. No.: 514,590

[52] U.S. Cl. ..... 219/300; 137/341; 137/563; 137/577; 219/301; 222/146 HE; 239/127; 239/135

[51] Int. Cl.[2] ..... H05B 3/00; B05B 1/24; F17D 1/18; B67D 5/62

[58] Field of Search ..... 219/296–309; 222/146 R, 146 H, 146 HE; 239/124–127, 133–136; 137/341, 577, 563

[56] References Cited

UNITED STATES PATENTS

| | | | |
|---|---|---|---|
| 466,336 | 1/1892 | Franklin | 137/577 X |
| 1,329,074 | 1/1920 | Fehan | 137/577 |
| 1,560,823 | 11/1925 | Jaenichen | 137/577 X |
| 2,224,403 | 12/1940 | Lines | 219/300 |
| 2,306,831 | 12/1942 | Proctor | 219/300 |
| 2,638,222 | 5/1953 | Roach | 137/577 |
| 2,851,197 | 9/1958 | Colton | 219/300 |

*Primary Examiner*—A. Bartis
*Attorney, Agent, or Firm*—Learman & McCulloch

[57] ABSTRACT

Apparatus for conveying a viscous liquid from a tank through a supply line to a device to be supplied with such liquid and thence to the tank via a return line, the liquid being heated either in the supply line or in the return line, or both. The apparatus includes concentric conduits extending into the tank and establishing supply and return passages connected respectively to the supply line and the return line. The conduits terminate at different levels inside the tank and the shorter of the conduits carries a sleeve at that end which is inside the tank and which is adjustable from outside the tank so as to vary the effective length of such conduit to enable the lower end of either conduit to extend beyond the lower end of the other conduit.

14 Claims, 4 Drawing Figures

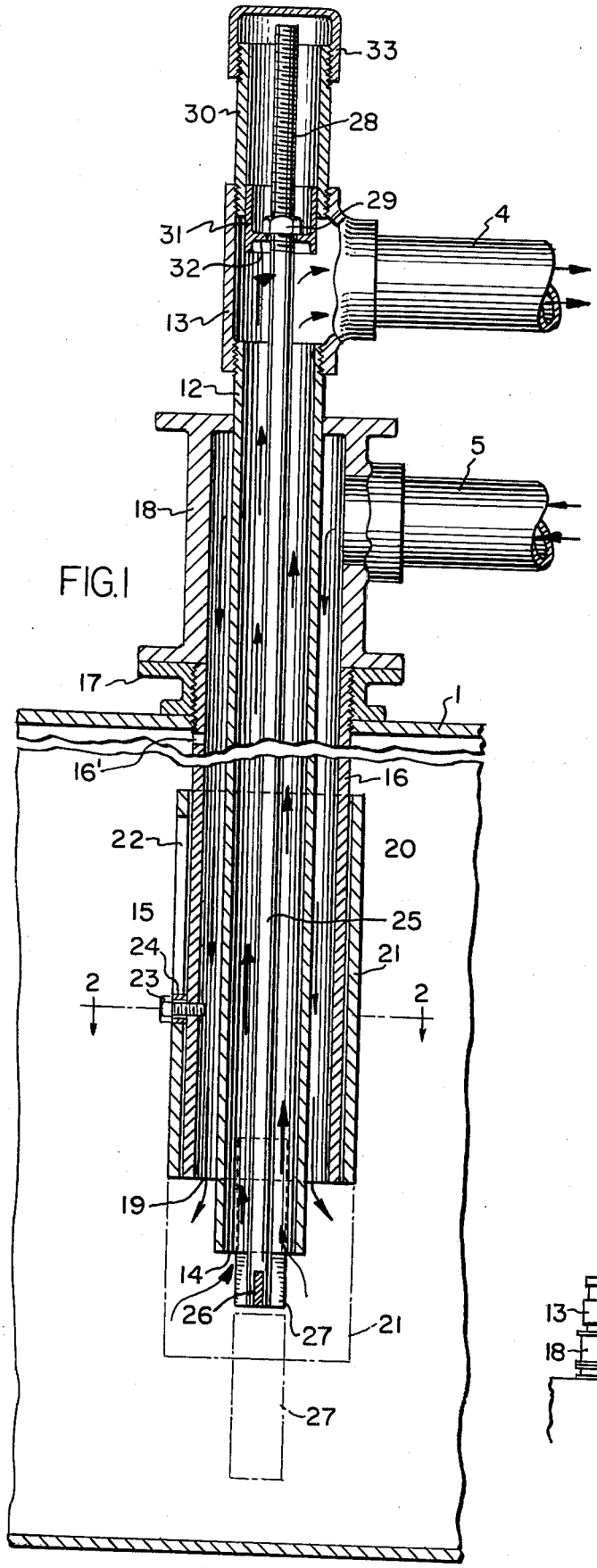
FIG.1
FIG.2
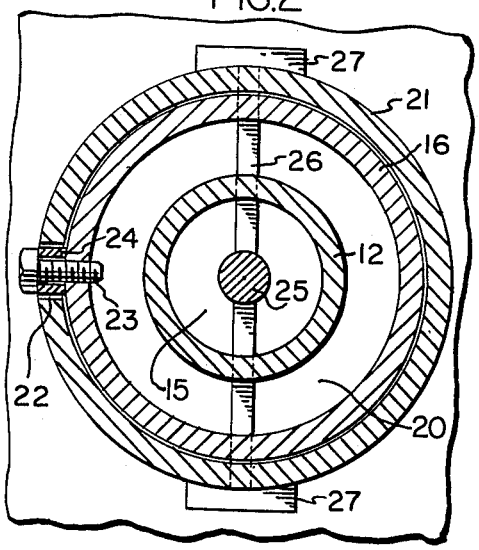
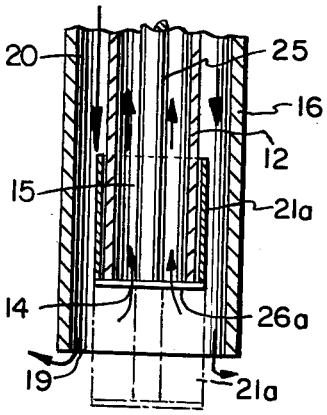
FIG.3
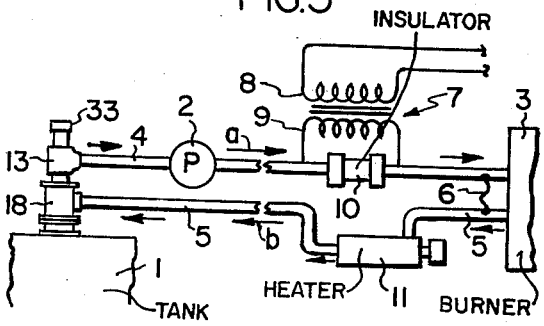
FIG.4

VISCOUS LIQUID CONVEYING APPARATUS

DESCRIPTION OF THE INVENTION

This invention relates to viscous liquid conveying apparatus and more particularly to apparatus for supplying fuel oil to a fuel oil burner, for example, the oil being supplied to the pump at a rate in excess of the capacity of the burner and the excess oil being returned to the tank.

Oil fired furnaces and boilers conventionally are supplied with fuel oil from a tank which is buried or otherwise installed outside the building in which the furnace or boiler is located. Oil from the tank is supplied to the burner via a supply line and at a rate in excess of the consumption of the burner. The excess oil is returned to the tank via a return line. The supply and return lines often are exposed to substantial changes in ambient temperature. As the temperature decreases, the viscosity of the oil increases, thereby affecting the efficiency of the oil conveying system. This problem has been recognized heretofore and numerous proposals have been advanced for its solution. For example, U.S. Pat. No. 2,224,403 discloses an oil storage and conveying system wherein the oil supply and return lines are heated electrically so that oil passing through those lines becomes heated and flows more readily.

Oil returned to the tank via the return line generally is less viscous than the reservoir of oil inasmuch as the returned oil has been heated. It has been the practice heretofore to utilize the heat of the returned oil to lower the viscosity of the reservoir oil in the immediate vicinity of the inlet opening of the oil supply line. Heating of the oil in the immediate vicinity of the inlet to the supply line facilitates the introduction of the oil to the conveying system. To avoid dissipation of the heat of the returned oil to areas of the reservoir where the heating of the oil would have no particular benefit, it has been the practice heretofore to return the heated oil to the reservoir via a pipe which surrounds that portion of the supply line which extends into the reservoir and to cause the lower end of the return pipe to project somewhat beyond the lower end of the supply line. The lower end of the return line thus forms a cowl around the inlet to the supply line so that the heated oil is the first to be readmitted to the supply line.

The extent to which the lower end of the return line projects beyond the corresponding end of the supply line is an important consideration if the maximum efficiency is to be achieved. Some kinds and grades of oils require different heat treatment in order to achieve their most efficient flow. That is, some oils require the application of heat for a greater period of time than is required by other oils to reach acceptable flow characteristics. The time to which oil in a tank is exposed to the heat of returned oil is directly related to the extent to which the return line extends beyond the supply line. Thus, if the return line projects, say, three inches beyond the end of the supply line, the amount of the returned oil which can escape the return line before being reintroduced to the supply line will be relatively small, thereby enabling only a relatively small amount of reservoir oil to be heated by the return oil and for only a relatively short time. Conversely, if the return line projects only one inch beyond the supply line, a greater quantity of the returned oil will escape the return line so as to heat a greater quantity of the reservoir oil and for a longer period of time.

Until fairly recently the particular kind and grade of oil to be consumed at a particular installation could be selected with assurance that the continued supply of such fuel would be available in the future. More recently, however, the kinds of fuel oils which may be burned have been the subject of legislative and other regulatory restrictions so as to minimize atmospheric pollution. Those fuel oil systems which were installed prior to the required change in the kinds of oil which thereafter could be utilized almost invariably require a change to be made in the relationship between the supply line and the return line. In most instances, this modification necessitates excavation to obtain access to the supply and return lines, disconnection of those portions of such lines which enter the tank from other portions of the lines, and physical modification or replacement of the tank-immersed lines. Such an undertaking is expensive. Moreover, the most efficient relationship between the supply and return lines can be determined only empirically with the result that either extensive on site tinkering is required or maximum efficiency is sacrificed. Even in those instances in which the best possible relationship between the supply and return lines is achieved for a given season, seasonal changes, as well as subsequent fuel oil modifications, may require further adjustment of the supply and return lines thereby necessitating repetition of the adjustment procedures.

An object of this invention is to provide apparatus for conveying viscous liquids, such as fuel oil, to and from a reservoir and wherein concentric supply and return conduits located in the reservoir may have their relative positions adjusted axially from outside the reservoir to any one of a number of selected positions of adjustment.

Another object of the invention is to provide apparatus of the character described which does not interfere in any way with the normal operation of the system in which it is incorporated and which is economical to manufacture and simple to use.

Other objects and advantages of the invention will be pointed out specifically or will become apparent from the following description when it is considered in conjunction with the appended claims and the accompanying drawings in which:

In summary, the invention comprises apparatus for conveying a viscous liquid from and to a storage tank and includes a supply pipe through which liquid may be withdrawn from the tank and a return pipe concentric with the supply pipe and through which heated liquid may be returned to the tank. One of the pipes terminates at a higher level within the tank than does the other pipe, and the higher level pipe is provided with a sleeve at its lower end which is adjustable axially of such pipe from outside the tank so as to vary the effective length of the shorter pipe by an amount such as to enable either pipe to constitute the lower level pipe. By adjustment of the sleeve the amount of heat transferred from the returned liquid to the liquid in the tank can be controlled.

FIG. 1 is a fragmentary side elevational view, partly in section, of apparatus constructed in accordance with one embodiment of the invention;

FIG. 2 is an enlarged, transverse sectional view taken on the line 2—2 of FIG. 1;

FIG. 3 is a sectional detail of a modified form of the invention; and

FIG. 4 is a schematic diagram of a system with which apparatus according to the invention is adapted for use.

Apparatus constructed in accordance with either of the disclosed embodiments of the invention is adapted for use in a system such as that disclosed in FIG. 4 wherein a quantity of oil is stored in a tank 1 and is withdrawn by means of a pump 2 for delivery in the direction of the arrow *a* to an oil burner 3 via a supply line 4. Oil is delivered to the burner 3 at a rate in excess of the burner's capacity. The excess oil is delivered from the burner to a return line 5 which conveys the oil in the direction of the arrow *b* back to the tank 1.

The lines 4 and 5 may be formed of electrically conductive material and may be joined adjacent the burner ends thereof by a conductive jumper 6. The lines 4 and 5 may be heated electrically by means of a transformer 7 having a primary winding 8 connected to a source of alternating energy and a secondary winding 9 connected to the supply line 4 on opposite sides of an electrically insulating sleeve 10 which forms part of the supply line. If desired, the return line 5 may pass through a steam jacket 11 or the like which is supplied with a heating medium so as to raise the temperature of oil flowing through the return line.

In the embodiment disclosed in FIGS. 1 and 2, the supply line 4 includes a tube or conduit 12 that extends vertically into the tank 1 and is joined at its upper end to a tee fitting 13. The lower end of the tube 12 terminates in an open mouth 14 which is located at a predetermined distance, such as 5 inches, above the bottom of the tank. The interior of the conduit 12 forms a passage 15 which communicates with the line 4 via the fitting 13.

The conduit 12 is encircled by a concentric, larger diameter conduit 16 which is supported at its upper end in a fitting 17 mounted on the tank 1 and in communication with a coupling 18 that communicates with the return line 5. The lower end of the conduit 16 terminates in an open mouth 19 which occupies a position above the level of the mouth 14 of the conduit 12. Since the diameter of the conduit 16 and the coupling 18 is larger than that of the conduit 12, an annular space 20 surrounds the conduit 12 and forms a passage for oil discharged from the return line 5. A vent opening 16′ is provided in the conduit 16 adjacent the upper end of the tank.

Encircling the lower end of the conduit 16 is a sleeve 21 which snugly, but slidably, receives the conduit 16. The sleeve 21 has an axial slot 22 in which is accommodated a limit and guide screw 23 and a spacer 24. The screw extends through a threaded opening in the conduit 16. The arrangement is such that the sleeve 21 is axially adjustable relatively to the conduit 16 a distance corresponding substantially to the length of the slot 22.

Means for adjusting the sleeve 21 axially of the conduit 16, and from outside the tank 1, comprises a rod 25 which extends completely through the conduit 12 and the fitting 13 and which is fixed at its lower end to a bar 26 which lies below the mouth 14 and is joined at its opposite ends to hanger straps 27 that are fixed to the sleeve 21. The upper end of the rod 25 is threaded as at 28 for reception of an adjusting nut 29 and is received in a tubular housing 30 that is threaded into the fitting 13. The housing carries a plug 31 having a seat 32 on which the nut 29 rests. The upper end of the housing 30 is closed by a removable cover 33.

In the position of the sleeve 21 shown in full lines in FIG. 1, its lower end is at the same level as that of the mouth 19 of the return conduit 16. In this position of the sleeve, oil discharged from the mouth 19 of the return line 16 is free to flow downwardly and laterally so as to warm a considerable volume of oil in the vicinity of the mouth of the supply conduit 12. However, the sleeve 21 may be adjusted downwardly as indicated in chain lines in FIG. 1, so as to increase the effective length of the return line. In the adjusted position the lower end of the sleeve extends to a level below the mouth 14 of the supply conduit and forms a cowl around the mouth of the supply conduit. Thus, oil discharged through the mouth 19 of the return conduit 16 is prevented by the sleeve from spreading laterally, thereby concentrating the heat of the returned oil in the immediate vicinity of the mouth 14 of the supply conduit.

The axial adjustment of the sleeve 21 is effected quite simply by removing the cover 33 from the housing 30 and rotating the nut 29 on the threaded end 28 of the rod 25. The sleeve 21 may be adjusted to any selected position between its upper and lower limits, and suitable indicia (not shown) may be provided on the upper end of the rod 25 to indicate the extent to which the sleeve projects above and below the mouth 14 of the supply conduit 12.

The embodiment shown in FIG. 3 is similar to the earlier described embodiment but differs from the latter in that the return conduit 16 projects below the mouth 14 of the supply conduit 12 so that the mouth 19 of the return conduit normally occupies a position below the mouth 14 of the supply conduit. In the modified embodiment a sleeve 21*a*, similar to the sleeve 21, slidably encircles the lower end of the supply conduit 12 and is coupled to the adjusting rod 25 by a cross bar 26*a*. In all other respects, the embodiments of FIGS. 1 and 3 are the same.

The sleeve 21*a* may be adjusted axially of the conduit 12 from the full line position shown in FIG. 3 to the chain line position so that, in effect, the mouth of the supply conduit may be positioned either above or below the level of the mouth 19 of the return conduit 16.

In the event the vent opening 16′ should become plugged, or should air collect in the conduit 16 for any other reason, there is a possibility that such air would be drawn into the mouth of the supply conduit 12 when the latter is at a level higher than that of the mouth 14 and result in erratic operation of the pump or burner. When air is suspected of being entrained in the supply conduit, the sleeve 21 or 21*a* may be raised or lowered, respectively, for a short period of time to allow air to escape into the tank.

The disclosed embodiments are representative of presently preferred forms of the invention, but are intended to be illustrative rather than definitive thereof. The invention is defined in the claims.

I claim:

1. Viscous liquid conveying apparatus comprising a tank having a bottom for containing a supply of viscous liquid; a device for receiving liquid from said tank; a supply line extending into said tank toward said bottom and having one end terminating at a predetermined level from said bottom in an open mouth, said supply line having its other end connected to said device; a return line having one end extending into said tank in concentric relation with said supply line and having its other end connected to said device, said one end of said return line terminating in an open mouth adjacent the mouth of said supply line but at a different level from said bottom; means for delivering liquid from said tank to said device via said supply line and for returning liquid from said device to said tank via said return line; means for heating liquid returned to said tank via said return line; a tubular member snugly but slidably fitted on the higher level one of said lines adjacent its mouth for back and forth movements toward and away from the bottom of said tank to adjust the effective length of said higher level one of said lines and thereby the position of its mouth at a selected level above or below the level of the mouth of the other of said lines; and operating means connected to said tubular member for moving the latter.

2. Apparatus according to claim 1 wherein the mouth of said supply line is at a higher level above said bottom than the mouth of said return line and wherein said tubular member is fitted on said supply line.

3. Apparatus according to claim 1 wherein the mouth of said return line is at a higher level above said bottom than the mouth of said supply line and wherein said tubular member is fitted on said return line.

4. Apparatus according to claim 1 wherein said operating means extends from said tubular member to a position external of said tank.

5. Apparatus according to claim 1 including means for maintaining said tubular member in any one of a number of selected positions of adjustment relative to the mouth of said other of said lines.

6. Apparatus according to claim 1 including means reacting between said tubular member and said one of said lines for guiding said tubular member in its movements.

7. Apparatus according to claim 1 wherein said supply line is within said return line at said one end of said lines.

8. Viscous liquid conveying apparatus adapted for immersion in a reservoir of liquid for withdrawing and returning liquid from and to said reservoir, said apparatus comprising a first conduit having an open mouth at one end; a second conduit, said second conduit having an open mouth at one end, said second conduit being positioned within said first conduit in radially spaced relation therewith and with the open mouths of said conduits adjacent but axially spaced from one another whereby the one end of one of said conduits projects beyond the open mouth of the other of said conduits; sleeve means snugly but slidably fitted to said other of said conduits adjacent its mouth for back and forth axial movements thereon to vary the effective length of said other of said conduits and the position of its mouth relative to the mouth of said one of said conduits an amount sufficient that the mouth of said other of said conduits can be made to selectively project beyond the mouth of said one of said conduits; and operating means connected to said sleeve means for adjusting the latter.

9. Apparatus according to claim 8 wherein said sleeve means is fitted to said first conduit.

10. Apparatus according to claim 8 wherein said sleeve means is fitted to said second conduit.

11. Apparatus according to claim 8 wherein said operating means extends beyond the opposite end of said conduits.

12. Apparatus according to claim 11 wherein said operating means extends through said first conduit.

13. Apparatus according to claim 8 including adjustable means carried by said operating means for maintaining the latter in a selected position of adjustment.

14. Apparatus according to claim 8 including means reacting between said one of said conduits and said sleeve means for guiding the latter and limiting the extent of its adjustment.

* * * * *